US010814331B2

(12) United States Patent
Canabes Guerra

(10) Patent No.: US 10,814,331 B2
(45) Date of Patent: Oct. 27, 2020

(54) LIFTING WALL ARRANGEMENT AND A SEGMENT OF A LIFTING WALL ARRANGEMENT

(71) Applicant: METSO SWEDEN AB, Trelleborg (SE)

(72) Inventor: Cristian Alejandro Canabes Guerra, Valparaiso (CL)

(73) Assignee: METSO SWEDEN AB, Trelleborg (SE)

( * ) Notice: Subject to any disclaimer, the term of this patent is extended or adjusted under 35 U.S.C. 154(b) by 274 days.

(21) Appl. No.: 15/952,422

(22) PCT Filed: Oct. 7, 2016

(86) PCT No.: PCT/EP2016/074068
§ 371 (c)(1),
(2) Date: Apr. 13, 2018

(87) PCT Pub. No.: WO2017/063954
PCT Pub. Date: Apr. 20, 2017

(65) Prior Publication Data

US 2018/0257082 A1 Sep. 13, 2018

(30) Foreign Application Priority Data

Oct. 16, 2015 (EP) ..... 15190107

(51) Int. Cl.
*B02C 17/00* (2006.01)
*B02C 17/18* (2006.01)
*B02C 17/04* (2006.01)

(52) U.S. Cl.
CPC ..... *B02C 17/1825* (2013.01); *B02C 17/04* (2013.01); *B02C 17/1855* (2013.01)

(58) Field of Classification Search
CPC .. B02C 17/1825; B02C 17/04; B02C 17/1855
(Continued)

(56) References Cited

U.S. PATENT DOCUMENTS 1,153,239 A * 9/1915 Marcy ..... B02C 17/1855 241/70
1,183,431 A * 5/1916 Carlson ..... B02C 17/1855 241/70
(Continued)

FOREIGN PATENT DOCUMENTS

CN 102740980 A 10/2012
CN 103861700 A 6/2014
(Continued)

OTHER PUBLICATIONS

International Search Report and Written Opinion for International Patent Application No. PCT/EP2016/074068 dated Jan. 5, 2017.
(Continued)

*Primary Examiner* — Faye Francis
(74) *Attorney, Agent, or Firm* — Andrus Intellectual Property Law, LLP

(57) ABSTRACT

A lifting wall arrangement at an end wall of a drum mill, having a plurality of segments which are removably installable on the end wall. Each segment includes an inner wall and an opposing outer wall. At least one lifting blade is arranged on the outer wall, such that the outer wall, the lifting blade and the inner wall define a discharge channel leading to a discharge cone. The inner wall forms a part of a sieving wall in the drum mill. Each segment constitutes an integrated unit adapted to be installed on the end wall. Other embodiments include a segment of a lifting wall arrangement and a drum mill having a lifting wall arrangement.

11 Claims, 3 Drawing Sheets

(58) Field of Classification Search
USPC ..... 241/182, 183
See application file for complete search history.

(56) References Cited

U.S. PATENT DOCUMENTS

| | | | | | |
|---|---|---|---|---|---|
| 1,335,269 | A | * | 3/1920 | Ball | B02C 17/06 241/70 |
| 1,337,641 | A | * | 4/1920 | Canda | B02C 17/22 241/70 |
| 1,362,334 | A | * | 12/1920 | Marcy | B02C 17/1855 241/70 |
| 2,611,546 | A | * | 9/1952 | Ejnar | B02C 17/22 241/183 |
| 3,191,874 | A | * | 6/1965 | Drinkwater | B02C 17/22 241/183 |
| 3,318,537 | A | * | 5/1967 | Wallin | B02C 17/22 241/183 |
| 3,799,458 | A | | 3/1974 | Lutke-Cossmann | |
| 4,177,955 | A | * | 12/1979 | Miller | B02C 17/22 241/183 |
| 4,319,719 | A | * | 3/1982 | Larsen | B02C 17/22 241/183 |
| 4,365,763 | A | | 12/1982 | Guerguerian | |
| 4,402,465 | A | * | 9/1983 | Persson | B02C 17/225 241/183 |
| 4,583,575 | A | * | 4/1986 | Lundmark | B27L 1/025 144/208.9 |
| 4,646,890 | A | | 3/1987 | Yamanda et al. | |
| 4,646,980 | A | | 3/1987 | Player et al. | |
| 4,668,183 | A | * | 5/1987 | Patterson | F27B 7/162 432/80 |
| 4,848,681 | A | * | 7/1989 | Eriksson | B02C 17/225 241/183 |
| 5,161,745 | A | | 11/1992 | Valeri et al. | |
| 5,431,351 | A | * | 7/1995 | Lejonklou | B02C 17/225 241/183 |
| 5,752,665 | A | * | 5/1998 | Wason | B02C 17/225 241/183 |
| 6,036,127 | A | * | 3/2000 | Moller | B02C 17/225 241/183 |
| 7,566,017 | B2 | * | 7/2009 | Latchireddi | B02C 17/1825 241/183 |
| 7,887,000 | B2 | * | 2/2011 | Siitonen | B02C 17/1825 241/183 |

FOREIGN PATENT DOCUMENTS

| | | | |
|---|---|---|---|
| CN | 203842644 | U | 9/2014 |
| CN | 204294301 | U | 4/2015 |
| CN | 205361519 | U | 7/2016 |
| WO | 2011095692 | A1 | 8/2011 |

OTHER PUBLICATIONS

International Preliminary Report on Patentability for International Patent Application No. PCT/EP2016/074068 dated Dec. 5, 2017.
Office Action for Chinese Patent Application No. 2016800604085 dated May 29, 2019.
Office Action for Eurasian Patent Application No. 201890978 dated Jun. 24, 2019.

* cited by examiner

LIFTING WALL ARRANGEMENT AND A SEGMENT OF A LIFTING WALL ARRANGEMENT

CROSS-REFERENCE TO RELATED APPLICATIONS

This application is the U.S. national stage application of International Application PCT/EP2016/074068, filed Oct. 7, 2016, which international application was published on Apr. 20, 2017, as International Publication WO 2017/063954 in the English language. The International Application claims priority of EP Patent Application 15190107.1, filed Oct. 16, 2015.

TECHNICAL FIELD

The present invention relates to a lifting wall arrangement at and end wall of a drum mill. The invention further relates to a segment of a lifting wall arrangement and a drum mill comprising a lifting wall arrangement.

BACKGROUND

In a rotating drum mill material in the form of crushed ore is fed into one end of the mill, the input end wall, and milled ore is extracted through a centrally positioned material output tap at the second end of the mill, the output end wall. In materials processing a grinder is a machine for producing particle size reduction through attrition and compressive forces at the grain size level. A typical type of fine grinder is the drum mill. Water is supplied during the milling such that finely divided ore particles and water form a pulp or slurry. The drum mill typically comprises a shell forming a large, principally cylindrical, compartment located between the input end wall and the output end wall. This compartment is generally known as the grinding chamber. In association with the output end wall a lifting wall arrangement is arranged for the discharge of pulp from the grinding chamber. The lifting wall arrangement comprises a plurality of pulp lifters, wherein each pulp lifter generally comprises an inner wall facing the grinding chamber and an opposing outer wall facing the output end wall. The pulp lifters are arranged radially in relation to the rotation axis and rotate with the mill. A lifting wall arrangement may comprise radially inner pulp lifters and radially outer pulp lifters. A number of radially arranged limiting walls or carriers are provided on the inner or the outer wall, evenly distributed around the rotation axis. Said carriers define a number of compartments, known as pulp lifting chambers, together with the inner wall and the outer wall. The pulp lifting chambers typically become narrower in the direction towards the centre of rotation where the pulp is lead to a central discharge cone. The discharge cone extends into the output tap. The inner wall of a pulp lifter typically comprises sieving openings through which the pulp or slurry is entering the pulp lifting chamber. During rotation of the mill, the pulp in the grinding chamber is thus led through the sieving openings, into the pulp lifting chambers when the pulp lifter is positioned at a lower position of the rotation. When the pulp lifter has reached an upper position of the rotation, the pulp falls down towards the discharge cone and thus the output tap. The pulp lifting chambers thus form a number of discharge channels whose task it is to lead the mineral-containing pulp out from the grinding chamber of the mill during rotation of the mill. As used herein the term pulp also includes slurry, as well as other materials being ground.

A common problem with lifting wall arrangements of today is the installation and removal of the separate components. The outer wall of each pulp lifter is typically first arranged on a correct position and attached to the output end wall of the mill by bolts from the inside of the mill. The inner wall is subsequently attached to the outer wall by long bolts extending through the inner wall and the outer wall. This procedure is cumbersome and time consuming. It should also be pointed out that the long bolts are heavy and awkward to handle by an operator during assembly and disassembly work. Document WO 2011/095692 A1 for examples discloses a pulp lifter assembly for a rotary grinding mill where a grate is attached to each pulp lifter with fasteners.

Document U.S. Pat. No. 3,799,458 A discloses a tube mill material lifting wall comprising two discs each being composed of individual segments, wherein opposing segments are joined at their outer ends and has lifting blades there between adapted to lift the material being treated within the drum as it rotates. The opposing segments are connected in pairs by a connecting web affixed to the casing of the tube mill to form a member with a U-cross-section. The segments are thus welded to their connecting web so that they form a rigid unit. The web is screwed to the tube mill casing. The segments are also fixedly joined by spacer elements. This is a complex construction which will result in a time consuming and inconvenient installation and maintenance of the components of the lifting wall.

Various constructions of lifting wall arrangements thus exist but there is still a need to develop a lifting wall arrangement, which reduces the time for installation/removal of various components and which optimises the weight of the lifting wall arrangement.

SUMMARY OF THE INVENTION

An object of the present invention is to achieve a lifting wall arrangement which results in improved handling, installation and maintenance service.

Another object of the invention is to achieve a lifting wall arrangement which is suitable for automated installation.

A further object of the invention is to achieve a lifting wall arrangement with an optimized weight.

A further object of the present invention is to achieve a segment of a lifting wall arrangement which results in improved handling, installation and maintenance service.

Another object of the invention is to achieve a drum mill which results in cost-effective handling, installation and maintenance service.

According to an aspect of the invention a lifting wall arrangement at an end wall of a drum mill is provided. The lifting wall arrangement has a plurality of segments which are removably installable on the end wall, wherein each segment comprises an inner wall and an opposing outer wall, wherein at least one lifting blade is arranged on said outer wall, such that the outer wall, the lifting blade and the inner wall define a discharge channel leading to a central discharge cone, and wherein said inner wall forms a part of a sieving wall facing a grinding chamber in the drum mill, wherein each segment constitutes an integrated unit adapted to be installed on the end wall. By designing each segment of the lifting wall arrangement as individual integrated units the installation and the removal of the segment is facilitated. Since the segment is a one-piece unit the amount of fasteners needed to attach the segment to the end wall is reduced. Instead of first attaching the outer wall to the end wall and subsequently attaching the inner wall to the outer wall as in common lifting wall arrangements, the inner wall and the outer wall are manufactured as one integrated unit and are thus connected prior to mounting on the end wall. This way, both components are preassembled into a one piece unit that can be immediately installed on the end wall. Hence, the number of fasteners needed can be reduced. Also, since the long bolts used to attach the inner wall to the outer wall are avoided, the weight of the lifting wall arrangement is optimised. A lifting wall arrangement is thereby achieved, which results in improved handling, installation and maintenance service and facilitates assembly and disassembly work.

The lifting wall arrangement is essentially configured as a circular disk or plate. The segments are radially arranged in relation to the rotation axis of the drum mill. The segments are thus typically configured as sectors of a circle circumferentially surrounding the central discharge cone. The lifting wall arrangement comprises at least one circle of interconnected segments or suitably two interconnected segments arranged as an outer circle and an inner circle. The outer segments are thus arranged radially on the outside of the inner segments and thereby closer to the periphery of the lifting wall arrangement. The lifting wall arrangement may alternatively comprise outer segments, intermediate segments and inner segments. The segments of the lifting wall arrangement may be arcuate or curved. The segments may alternatively have a semi-curved, a dogleg or any other known configuration.

The integrated unit is preferably adapted to be attached to the end wall from the outside of the drum mill. The integrated unit is suitably adapted to be attached to the end wall only from the outside of the drum mill. This further facilitates the installation and removal of the individual segments and the lifting wall arrangement may thereby be suitable for automated installation. The individual segments may thereby be installed/removed by means of a robot provided with a lift arm or similar handling device. To facilitate handling, the segment inner wall of the integrated unit may be equipped with lifting eyes. In this way, the installation procedure may be streamlined and thereby simplified.

The integrated unit suitably comprises first mounting means adapted to, through mounting holes in the end wall, interact with complementary second mounting means installable from the outside of the drum mill. The first mounting means preferably comprises a fastener body insert arranged in a recess in the wall of the integrated unit facing the end wall. The fastener body insert suitably constitutes a threaded bushing or sleeve which can be tubular. The first mounting means is thus arranged in a recess in the outer wall of the segment such that the first mounting means is facing the mounting hole. The second mounting means may thereby be installed from the outside of the drum mill such that it interacts with the first mounting means. In the case where the first mounting means is a threaded bushing or similar the second mounting means suitably constitutes a threaded bolt or similar. Since the segment is an integrated unit the number of fixing points can be reduced and the allocation of fixing points can be limited to the outer wall. This way, a rigid and resistant construction is achieved.

The first mounting means may comprise a guide member projecting from the recess, wherein the guide member is adapted to guide the integrated unit to a correct position against the end wall by interaction with the mounting holes.

The inner wall of the integrated unit preferably comprises sieving openings. In the case where the lifting wall arrangement comprises several circles of segments, the outer segments suitably comprise inner walls with sieving openings whereas the intermediate and/or inner segments comprise inner walls without sieving openings. A front wall comprising sieving openings is suitably called a grate. A front wall not comprising sieving openings is suitably called a blind grate. The segments with sieving openings are suitably arranged along the periphery of the lifting wall arrangement such that when the segment is in a bottom position during rotation of the mill, grinded material (pulp) will enter through the sieving openings into the discharge channel of the segment. As the lifting wall arrangement rotates and the segment reaches a top position, the pulp will fall through the discharge channels in the inner segments to the central discharge cone. The lifting wall arrangement thus constitutes a discharge system for the drum mill.

The inner wall and the outer wall of the segment are can be connected by vulcanizing and thereby form an integrated unit. The segment can alternatively be formed as an integrated unit by chemical bonding or mechanical connection. Vulcanizing or casting are conceivable methods.

The segments may comprise polymer and/or metal and/or a ceramic material. The segments may comprise a compound. By forming the segments as integrated units of polymer materials, a light-weight lifting wall arrangement is achieved. The segments may comprise steel, or any wear or abrasive resistant materials such as Cr—Mo steels, white cast iron or any other known material having desired properties.

According to an aspect of the invention a segment of a lifting wall arrangement at and end wall of a drum mill is provided. The segment is removably installable on the end wall, wherein the segment comprises an inner wall and an opposing outer wall, wherein at least one lifting blade is arranged on said outer wall, such that the outer wall, the lifting blade and the inner wall define a discharge channel leading to a central discharge cone, and wherein said inner wall forms a part of a sieving wall facing a grinding chamber in the drum mill. The segment constitutes an integrated unit adapted to be installed on the end wall. The term lifting blade refers to any known mean such as blade, ribs or vanes which functions to lift any pulp which has left the grinding chamber through sieving opening or grids in a lifting wall and will deposit such pulp on a discharge cone.

Further objects, advantages and novel features of the present invention will become apparent to one skilled in the art from the following details, and also by putting the invention into practice. Whereas the invention is described below, it should be noted that it is not restricted to the specific details described. Specialists having access to the teachings herein will recognise further applications, modifications and incorporations within other fields, which are within the scope of the invention.

BRIEF DESCRIPTION OF THE DRAWINGS

For fuller understanding of the present invention and further objects and advantages of it, the detailed description set out below should be read together with the accompanying drawings, in which the same reference notations denote similar items in the various diagrams, and in which.

DETAILED DESCRIPTION OF THE DRAWINGS

Figure 1:
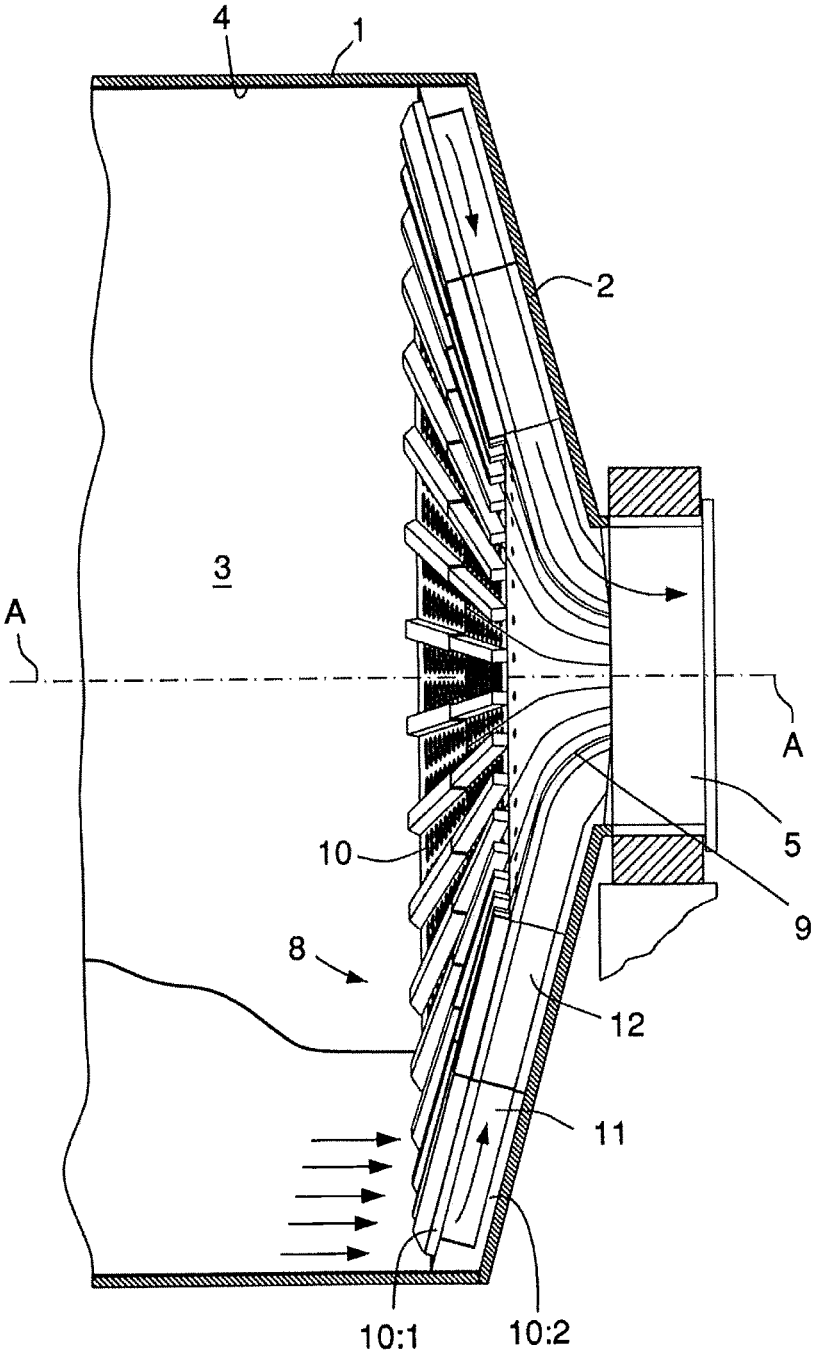
FIG. 1 schematically illustrates a drum mill comprising a lifting wall arrangement according to an embodiment of the invention.

FIG. 1 shows a part of a drum mill comprising a lifting wall arrangement according to an embodiment of the invention. The drum mill comprises a mill shell 1 and two end walls, an input end wall (not shown) and a discharge end wall 2. The mill shell 1 and the end walls 2 form a substantially cylindrical compartment called the grinding chamber 3. The drum mill rotates around a rotation axis A. The mill shell 1 is internally lined with a lining 4 of some wear-resistant material, for example an elastomer. A discharge trunnion 5 extends centrally from the discharge end wall 2. Inside the drum mill, at the discharge end wall 2, a rotating lifting wall arrangement 8 is provided. The lifting wall arrangement 8 is adapted to lift the grinded material inside the grinding chamber and lead it out of the drum mill through the discharge trunnion 5. The lifting wall arrangement 8 comprises a central discharge cone 9 and a plurality of segments 10 radially arranged circumferentially surrounding the discharge cone 9. The segments 10 are attached to the end wall 2 and the central discharge cone 9 is arranged in fluid communication with the discharge trunnion 5. The segments 10 may also be called pulp lifters. The lifting wall arrangement 8 is further described in FIG. 2.

Figure 2:
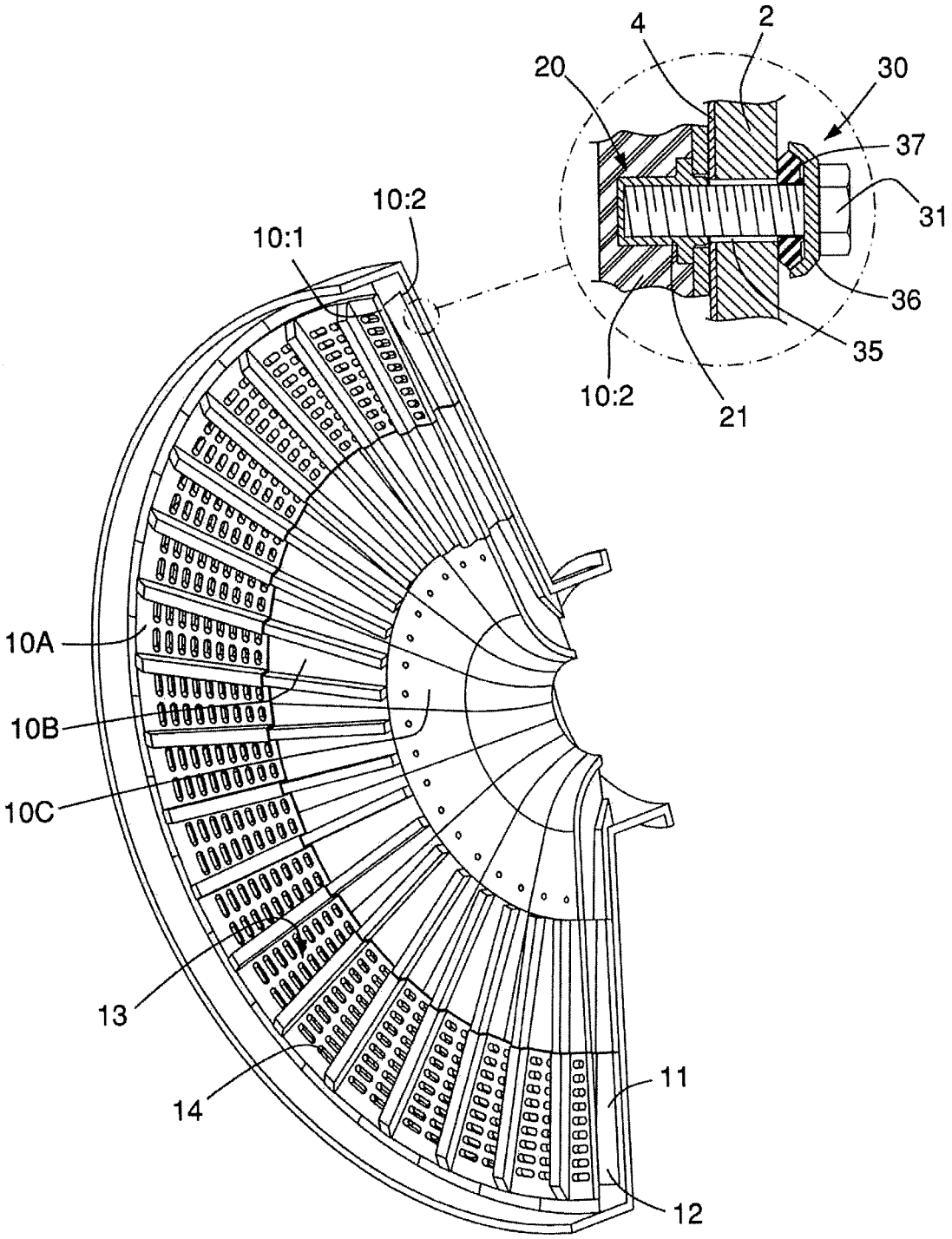
FIG. 2 schematically illustrates a lifting wall arrangement according to an embodiment of the invention.

FIG. 2 shows a cut section of a lifting wall arrangement 8 according to an embodiment of the invention. The lifting wall arrangement 8 is installed at an end wall 2 of the drum mill as described in FIG. 1. The lifting wall arrangement 8 has a plurality of segments 10 which are removably installable on the end wall. The segments are designed as sections of a circle and together form a circle, circumferentially surrounding the central discharge cone 9 of the lifting wall arrangement 8. According to this embodiment the lifting wall arrangement 8 comprises an outer circle of segments 10A, an intermediate circle of segments 10B and an inner circle of segments 10C. The circles of segments 10A, 10B, 10C and the discharge cone 9 together form a circular disk. Each segment 10 comprises an inner wall 10:1 and an opposing outer wall 10:2, wherein at least one lifting blade 11 is arranged on said outer wall 10:2, such that the outer wall, the lifting blade and the inner wall define a discharge channel 12 leading to the central discharge cone 9. The segment outer wall 10:2 is abutting the end wall 2 of the drum mill and the segment inner wall 10:1 forms a part of a sieving wall 13 facing the grinding chamber 3 in the drum mill. Each segment 10 constitutes an integrated unit adapted to be installed on the end wall 2.

With reference to FIG. 1 the segments 10 in the outer circle, called the outer segments 10A, comprise sieving openings 14 in the inner wall 10:1. The inner walls 10:1 of the outer segments 10A thus constitute grates. The inner walls 10:1 of the intermediate segments 10B and the inner segments 10C are so called blind grates, without sieving openings. When the outer segments 10A are in a bottom position during rotation of the mill, grinded material (pulp) will enter through the sieving openings 14 into the discharge channels 12 of the segments 10A, 10B, 10C. As the lifting wall arrangement 8 rotates and the outer segments 10A reach a top position, the pulp will be lead through the discharge channels 12 in the intermediate 10B and inner segments 10C to the central discharge cone 9 and out of the drum mill. Alternatively, all segments 10A, 10B, 10C can comprise sieving openings 14 in the inner wall 10:1.

As shown in the enlargement view in FIG. 2 the segments 10 constituting integrated units are suitably installed on the end wall 2 by means of first mounting means 20 which interact with complementary second mounting means 30 installed from the outside of the drum mill. The first mounting means 20 and the second mounting means 30 thus interact through mounting holes 35 in the end wall 2 of the mill drum.

FIGS. 3*a*-3*f* show segments 10 of a lifting wall arrangement 8 according to various embodiments of the invention. The segments 10 are configured as described in relation to FIG. 2 and thus comprise an inner wall 10:1 and an outer wall 10:2 and at least on lifting blade 12 integrated as a one-piece unit. The segments may be formed as integrated units by chemical bonding, mechanical connection or be configured to achieve a shape-bound connection with one another. Vulcanizing, casting, welding, gluing, bolting, riveting or any other known joining methods, depending on the selected combination material. The segments 10 may comprise elastic polymers, ceramic materials, cemented carbides steel alloys and/or metal or combinations thereof. The segments 10 may alternatively comprise a compound from any of the above mentioned materials. The segments specifically comprise wear-resistant materials such as a steel alloys suitable to be used in an iron ore mill.

Figure 3A:
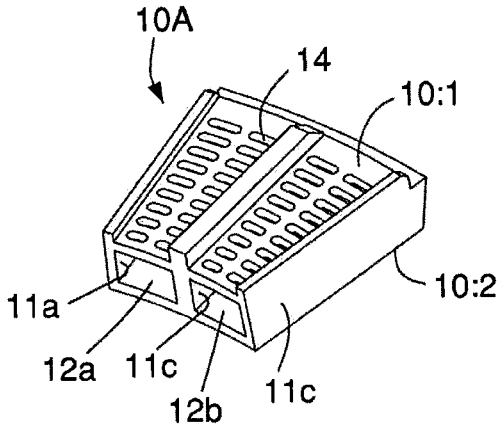
FIG. 3*a-f* schematically illustrates segments of a lifting wall arrangement according to various embodiments of the invention.

FIG. 3*a* shows a segment 10 configured as a section of a circle which comprises three lifting blades 11. One lifting blade 11*a*, 11*c* is radially arranged at each side of the segment 10 facing an adjacent segment and one lifting blade 11*b* is arranged there between. The lifting blades 11 are thus arranged such that two discharge channels are formed 12*a*, 12*b*. When two such segments 10 are arranged adjacent each other, one lifting blade of the first segment will abut a lifting blade of the second segment. The inner wall 10:1 comprises sieving openings 14 for the entry of grinded material into the discharge channels. The inner wall 10:1 is thus a grate. The discharge channels 12 may also be denominated pulp-lifting chambers. The segment according to FIG. 3*a* is suitably an outer segment 10A adapted to be arranged along the periphery of the lifting wall arrangement 8.

Figure 3B:
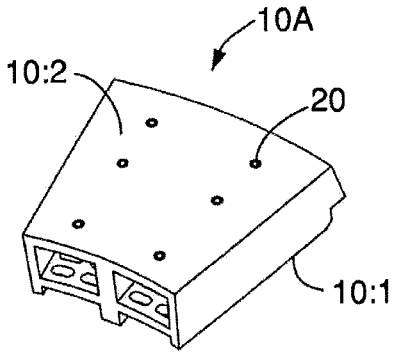

FIG. 3*b* shows the outer wall 10:2 of the segment 10 in FIG. 3*a*. With reference also to the enlargement view in FIG. 2 the outer wall 10:2 comprises first mounting means 20 in the form of fastener bodies 21 such as holding inserts arranged in recesses or bores in the outer wall. The segment 10 is adapted to be positioned such that the fastener bodies 21 are in line with mounting holes 35 in the end wall 2. Second mounting means 30 may thereby be installed from the outside of the drum mill such that it interacts with the first mounting means 20. The fastener bodies 21 are suitably threaded bushings or sleeves that can be tubular. The second mounting means 30 are suitably threaded bolts 31 or similar means interacting with the threaded bushings or sleeves. As shown in the enlargement in FIG. 2 a washer 36 can be placed between the head of the bolt 31. Also a rubber washer 37 can be arranged between the washer 36 and the outside of end wall 2 of the drum mill.

Figure 3C:
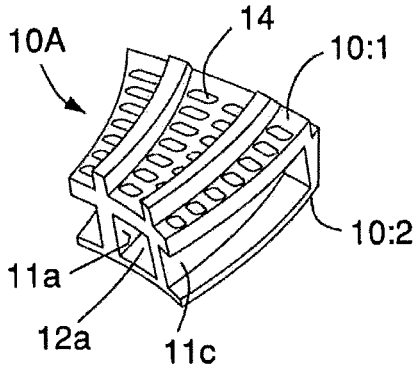

FIG. 3*c* shows an arcuate segment 10 comprising two lifting blades 11*a*, 11*c*. The lifting blades are arranged such that a discharge 12*a* channel is formed in the middle of the segment and such that the segment has open ends towards adjacent segments. This way, when two such segments 10 are arranged adjacent each other a discharge channel 12*a* will be formed between the two segments. The inner wall comprises sieving openings 14 for the entry of grinded material into the discharge channels 12. The segment 10 according to FIG. 3*c* may be an outer segment 10A adapted to be arranged along the periphery of the lifting wall arrangement 8.

Figure 3D:
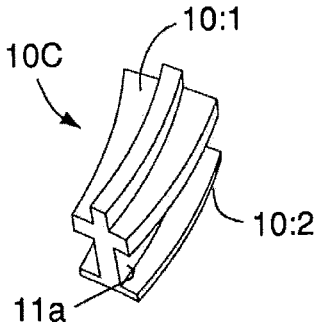
Figure 3E:
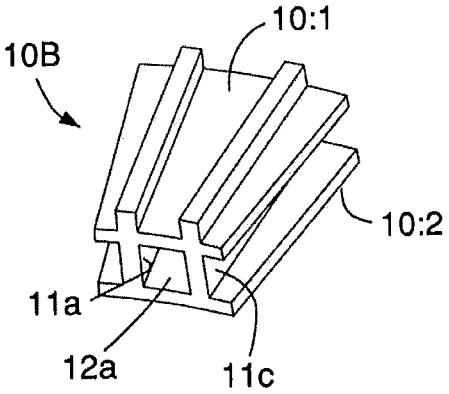
Figure 3F:
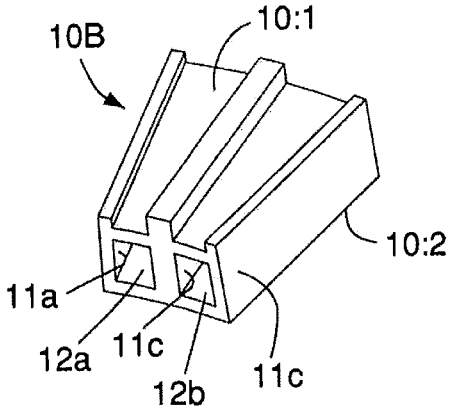

FIG. 3*d* shows an arcuate segment 10 comprising one lifting blade 11*a*. The lifting blade 11*a* is arranged centrally on the segment such that the segment has open ends towards adjacent segments. This way, when two such segments are arranged adjacent each other a discharge 12*a* channel will be formed between the two segments. The segment has an inner wall 10:1 without sieving openings, a so called blind grate. The segment is suitably an inner segment 10C adapted to be arranged in direct connection with the central discharge cone 9 of the lifting wall arrangement 8. FIGS. 3*e* and 3*f* show segments 10 configured as sections of a circle comprising inner walls 10:1 without sieving openings.

FIG. 3*e* shows a segment 10 comprising two lifting blades 11*a*, 11*c*. The lifting blades 11*a*, 11*c* are arranged such that a discharge channel 12 is formed in the middle of the segment and such that the segment has open ends towards adjacent segments. The segment is suitably an intermediate segment 10B. FIG. 3*f* comprises three lifting blades 11*a*, 11*b*, 11*c*. One lifting blade 11*a*, 11*c* is arranged at each side of the segment facing an adjacent segment and one lifting blade 11*b* is arranged there between. The lifting blades are thus arranged such that two discharge 12*a*, 12*b* channels are formed. The segment is suitably an intermediate segment 10B.

The foregoing description of the preferred embodiments of the present invention is provided for illustrative and descriptive purposes. It is not intended to be exhaustive or to restrict the invention to the variants described. Many modifications and variations will obviously be apparent to one skilled in the art. The embodiments have been chosen and described in order best to explain the principles of the invention and its practical applications and hence make it possible for specialists to understand the invention for various embodiments and with the various modifications appropriate to the intended use.

The invention claimed is:

1. A lifting wall arrangement configured to be installed at an end wall of a drum mill, having a plurality of segments which are removably installable on the end wall, wherein each segment comprises an inner wall and an opposing outer wall, wherein at least one lifting blade is arranged on said outer wall, such that the outer wall, the lifting blade and the inner wall define a discharge channel leading to a discharge cone, and wherein each segment constitutes an integrated unit adapted to be installed on the end wall, wherein the integrated unit is adapted to be attached to the end wall from the outside of the drum mill, wherein the integrated unit comprises first mounting means adapted to, through mounting holes in the end wall, interact with complementary second mounting means installed from the outside of the drum mill, and wherein the first mounting means comprises a fastener body insert arranged in a recess or a bore in the outer wall of the integrated unit facing the end wall.

2. A lifting wall arrangement according to claim 1, wherein the fastener body insert constitutes a threaded bushing or sleeve.

3. A lifting wall arrangement according to claim 1, wherein the inner wall of the integrated unit comprises sieving openings.

4. A lifting wall arrangement according to claim 1, wherein the inner wall and the outer wall of the segment are connected by chemical bonding or mechanical connection and thereby form an integrated unit.

5. A lifting wall arrangement according to claim 4, wherein the chemical bonding comprising one of the following vulcanization or gluing.

6. A lifting wall arrangement according to claim 4, wherein the mechanical connection comprising one of the following bolting or riveting.

7. A lifting wall arrangement according to claim 1, wherein each segment comprises polymer, metal, ceramic, or any combination thereof.

8. A lifting wall arrangement according to claim 1, wherein each segment is arcuate.

9. A segment of a lifting wall arrangement configured to be installed at an end wall of a drum mill, wherein the segment is removably installable on the end wall, wherein at least one lifting blade is arranged on said outer wall, such that the outer wall, the lifting blade and the inner wall define a discharge channel leading to a discharge cone, and wherein the segment constitutes an integrated unit adapted to be installed on the end wall wherein the segment is adapted to be attached to the end wall from the outside of the drum mill wherein the integrated unit comprises first mounting means adapted to, through mounting holes in the end wall, interact with complementary second mounting means installed from the outside of the drum mill, and wherein the first mounting means comprises a fastener body insert arranged in a recess or a bore in the outer wall of the integrated unit facing the end wall.

10. A segment according to claim 9, wherein the inner wall comprises sieving openings.

11. A drum mill, wherein it comprises a lifting wall arrangement according to claim 1.

* * * * *